US010337223B2

(12) United States Patent
Murphy

(10) Patent No.: US 10,337,223 B2
(45) Date of Patent: Jul. 2, 2019

(54) SHOWER DOOR HINGE ASSEMBLY

(71) Applicant: Kohler Co., Kohler, WI (US)

(72) Inventor: Roger W. Murphy, Kohler, WI (US)

(73) Assignee: KOHLER CO., Kohler, WI (US)

( * ) Notice: Subject to any disclaimer, the term of this patent is extended or adjusted under 35 U.S.C. 154(b) by 0 days.

(21) Appl. No.: 15/807,883

(22) Filed: Nov. 9, 2017

(65) Prior Publication Data

US 2018/0142507 A1 May 24, 2018

Related U.S. Application Data

(60) Provisional application No. 62/425,979, filed on Nov. 23, 2016.

(51) Int. Cl.
*E05D 7/00* (2006.01)
*E05D 11/06* (2006.01)
(Continued)

(52) U.S. Cl.
CPC ..... *E05D 7/00* (2013.01); *A47K 3/36* (2013.01); *E05D 11/06* (2013.01); *E05F 1/1284* (2013.01); *E05F 3/20* (2013.01); *E05F 5/02* (2013.01); *E05F 5/08* (2013.01); *E05D 11/02* (2013.01); *E05F 15/614* (2015.01); *E05Y 2201/212* (2013.01); *E05Y 2201/224* (2013.01); *E05Y 2900/114* (2013.01)

(58) Field of Classification Search
CPC ..... E05D 11/06; E05D 5/0246; E05D 2005/0261; E05D 2005/0269; E05F 1/1284; E05F 3/20; E05F 15/614; E05F 11/385; E05F 5/02; E05F 5/08; E05Y 2900/114; E05Y 2600/502; E05Y 2600/60; E05Y 2201/212; E05Y 2201/224; E06B 3/54; A47K 3/36; A47K 2003/367; A47K 3/12; A47K 3/125; A47K 3/362; A47F 3/12; A47F 3/125; Y10T 16/534; Y10T 16/541
See application file for complete search history.

(56) References Cited

U.S. PATENT DOCUMENTS 3,422,704 A * 1/1969 Catlett ..... E05F 15/614 475/4
4,211,451 A * 7/1980 Shephard ..... B60N 2/2251 16/344
(Continued)

*Primary Examiner* — Chuck Y Mah
(74) *Attorney, Agent, or Firm* — Foley & Lardner LLP

(57) ABSTRACT

A shower door hinge assembly includes a mount, an upper member, a lower member, a body, a plurality of gears, and a stop member. The mount is configured to be coupled to a fixed structure. The upper member is coupled to an upper portion of the mount, and the lower member is coupled to a lower portion of the mount. The body is rotatably coupled to the mount and is configured to be coupled to a pivotable shower door, wherein the body includes an inner wall having a plurality of splines defining a ring gear. The plurality of gears are disposed in the body and are configured to permit relative rotational movement between the body and the upper and lower members. The stop member is removably coupled between the inner wall of the body and one or more gears of the plurality of gears, and is configured to be selectively removed from, and repositioned within, the body to set a rotational endpoint for a pivotable shower door.

17 Claims, 6 Drawing Sheets

FIG. 4

(51) Int. Cl.

| | |
|---|---|
| ***E05F 5/02*** | (2006.01) |
| ***E05F 1/12*** | (2006.01) |
| ***E05F 3/20*** | (2006.01) |
| ***A47K 3/36*** | (2006.01) |
| ***E05F 5/08*** | (2006.01) |
| *E05F 15/614* | (2015.01) |
| *E05D 11/02* | (2006.01) |

(56) References Cited

U.S. PATENT DOCUMENTS 4,765,027 A 8/1988 Andric
5,195,210 A 3/1993 Lee
5,219,372 A 6/1993 Lee
5,221,239 A 6/1993 Catlett
5,462,498 A * 10/1995 Lindblad ..... B60N 2/0232 297/362
6,262,548 B1 7/2001 Scholten et al.
6,766,561 B1 * 7/2004 Cheng ..... E05D 5/0246 16/235
6,968,598 B2 * 11/2005 Becker ..... B60N 2/20 16/349
8,104,141 B2 * 1/2012 Yamashita ..... A47C 1/026 16/239
8,267,492 B2 * 9/2012 Lucas ..... E05D 3/022 16/354
8,448,383 B2 * 5/2013 Bode ..... E05F 15/63 49/334
2002/0026750 A1 3/2002 St. John et al.
2003/0005638 A1 1/2003 Son
2004/0107537 A1 * 6/2004 Ahn ..... H04M 1/0216 16/221
2004/0216273 A1 * 11/2004 Kang ..... G06F 1/1616 16/264
2007/0099747 A1 * 5/2007 Ando ..... F16H 55/0806 475/331
2007/0214725 A1 9/2007 Miyashita
2008/0103016 A1 * 5/2008 Nagy ..... F16H 1/28 475/331
2009/0070961 A1 * 3/2009 Chung ..... E05D 3/122 16/354
2010/0283367 A1 11/2010 Coleman et al.
2014/0338151 A1 11/2014 Mitchell et al.

* cited by examiner

SHOWER DOOR HINGE ASSEMBLY

CROSS-REFERENCE TO RELATED PATENT APPLICATIONS

This application claims the benefit of and priority to U.S. Provisional Application No. 62/425,979, filed Nov. 23, 2016, the entire disclosure of which is hereby incorporated by reference herein.

BACKGROUND

The present application relates generally to shower door assemblies. More specifically, the present application relates to a hinge assembly for a pivotable shower door.

SUMMARY

One embodiment relates to a shower door hinge assembly including a mount, an upper member, a lower member, a body, a plurality of gears, and a stop member. The mount is configured to be coupled to a fixed structure. The upper member is coupled to an upper portion of the mount, and the lower member is coupled to a lower portion of the mount. The body is rotatably coupled to the mount and is configured to be coupled to a pivotable shower door, wherein the body includes an inner wall having a plurality of splines defining a ring gear. The plurality of gears are disposed in the body and are configured to permit relative rotational movement between the body and the upper and lower members. The stop member is removably coupled between the inner wall of the body and one or more gears of the plurality of gears, and is configured to be selectively removed from, and repositioned within, the body to set a rotational endpoint for a pivotable shower door.

Another embodiment relates to a shower door hinge assembly including a mounting plate, an upper member, a lower member, a body, a plurality of gears, and a damper. The mounting plate is configured to be coupled to a fixed structure. The upper member is coupled to an upper portion of the mounting plate. The lower member is coupled to a lower portion of the mounting plate. The body is rotatably coupled to the upper and lower members and is configured to be coupled to a pivotable shower door, wherein the body includes an inner wall having a plurality of splines defining a ring gear. The plurality of gears are disposed in the body and are configured to permit relative rotational movement between the body and the upper and lower members. The damper is removably coupled to the inner wall of the body, wherein the damper is configured to elastically deform in response to contacting at least one of the plurality of gears during rotation of a pivotable shower door so as to provide a particular tactile response to a user.

Another embodiment relates to a shower door assembly including a pivotable shower door and a hinge assembly. The hinge assembly includes a mounting plate, an upper member, a lower member, a body, a plurality of gears, and a stop member. The hinge assembly is configured to pivotably couple the pivotable shower door to a fixed structure. The mounting plate is configured to be coupled to a fixed structure. The upper member is coupled to an upper portion of the mounting plate. The lower member is coupled to a lower portion of the mounting plate. The body is coupled to the pivotable shower door and is rotatably coupled to the upper and lower members, wherein the body includes an inner wall having a plurality of splines defining a ring gear. The plurality of gears are disposed in the body and are configured to permit relative rotational movement between the body and the upper and lower members. The stop member is removably coupled between the inner wall of the body and one or more gears of the plurality of gears. The stop member is configured to be selectively removed from, and repositioned within, the body to set a rotational endpoint for the pivotable shower door.

DETAILED DESCRIPTION

Generally speaking, a pivotable shower door can include one or more hinge assemblies for pivotably coupling the shower door within a shower or bathing environment. Most conventional hinge assemblies are sold pre-assembled with hinge posts or extensions for coupling to a shower door and to a fixed structure, such as a wall or a shower panel. A first portion of the hinge assembly can be coupled to a door panel and a second portion of the hinge assembly can be coupled to the fixed structure, so as to permit rotational movement of the shower door relative to the fixed structure.

The rotational position and/or rotational movement of these hinges is typically controlled using components or devices that are external to the hinge, such as striker plates coupled to a fixed structure, door stops coupled to a door or wall, or the like. These external components can offer somewhat limited control over the rotational position or rotational movement of the door. Thus, in some installation settings, the use of conventional shower door hinges can result in a door colliding into objects in the room due to space constraints or other structural limitations of the installation setting. For example, it can be difficult to prevent the shower door from colliding with objects present in these constrained areas during opening/closing of the door, which can subsequently cause damage to the objects (e.g., walls, plumbing fixtures, etc.) or to the shower door itself.

Referring generally to the FIGURES, disclosed herein are various embodiments of a hinge assembly for a pivotable shower door that can be selectively adjusted to control the rotational position of the door relative to a fixed structure. The hinge assembly can also be adjusted or reconfigured to assist with opening or closing of the door, and to provide a particular tactile response for a user. In this way, the hinge assembly can be customized to prevent the shower door from colliding with objects located in a bathing environment adjacent to the shower door (e.g., sinks, toilets, etc.), and can also provide assistance for a user attempting to open or close the shower door, depending on the user's needs or abilities.

Figure 1:
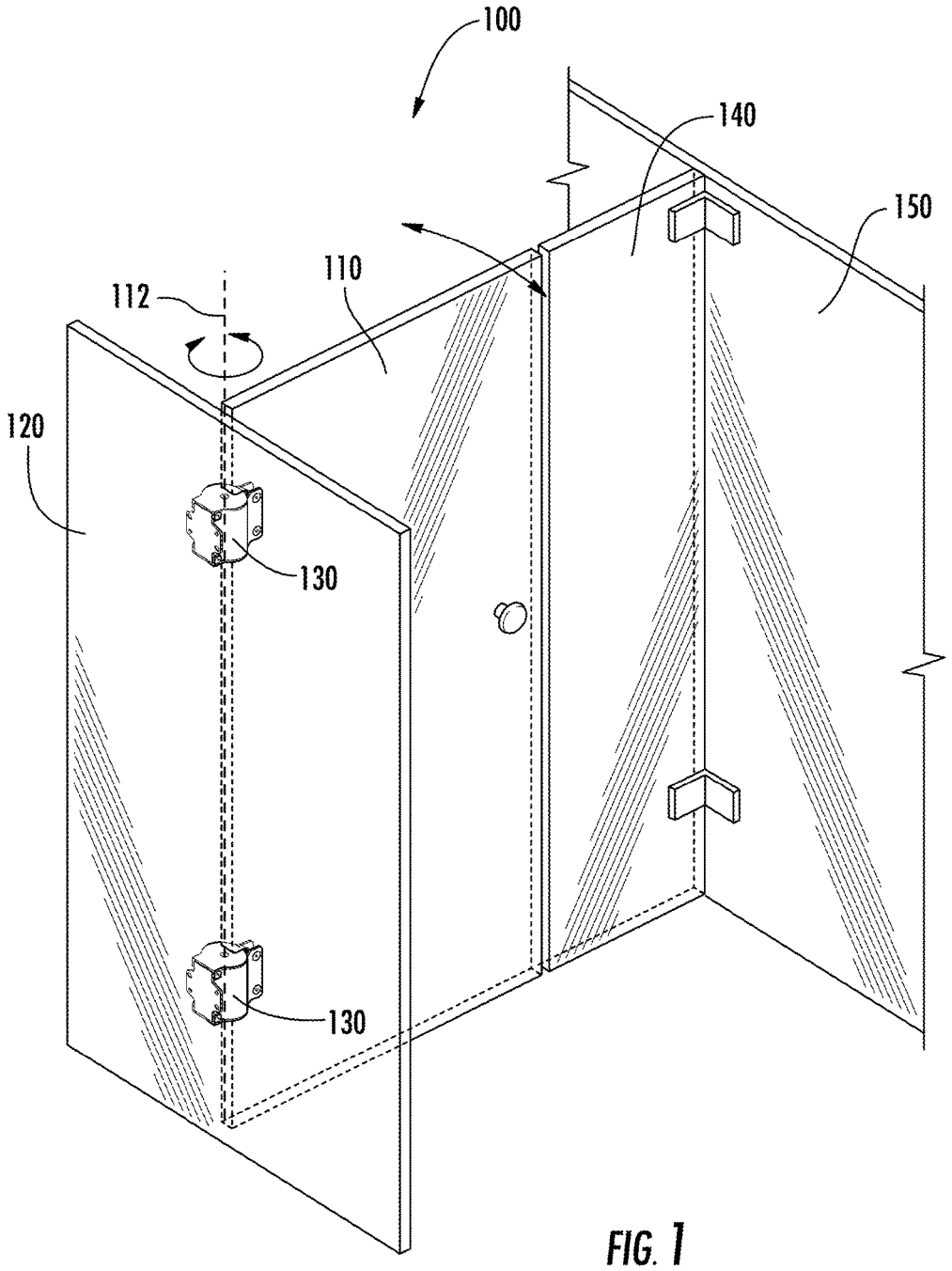
FIG. 1 is a perspective view of a shower door assembly according to an exemplary embodiment.

As shown in FIG. 1, a shower door assembly 100 is shown within a shower or bathing environment, such as a bathroom, according to an exemplary embodiment. The shower door assembly 100 is pivotably coupled to a fixed structure shown as a first shower panel 120 in FIG. 1. According to other exemplary embodiments, the shower door assembly 100 can be pivotably coupled to another type of fixed structure, such as a portion of a building, a wall, or other fixed structure. The shower door assembly 100 is positioned adjacent a second shower panel 140 located opposite the first shower panel 120. The second shower panel 140 is coupled to a fixed structure, shown as a wall 150 (e.g., a building wall, a shower wall, etc.). The first shower panel 120, the shower door assembly 100 and the second shower panel 140 cooperatively define at least a portion of a shower enclosure.

Still referring to FIG. 1, the shower door assembly 100 includes a door 110 (e.g., pivotable shower door, door panel, panel, etc.) and one or more hinge assemblies 130. The door 110 can be a generally planar panel made of glass. According to other exemplary embodiments, the door 110 is made from another rigid material or combinations of materials suitable for use in a bathing environment. According to the exemplary embodiment of FIG. 1, the door assembly 100 includes two hinge assemblies 130, although it is appreciated that more or fewer hinge assemblies may be included with the door 110. The hinge assemblies 130 pivotably couple the door 110 to the first shower panel 120, such that the door 110 can be pivoted or rotated about an axis 112 by a user between an open position and a closed position to, for example, allow for ingress/egress to/from the shower enclosure. The hinge assemblies 130 can, advantageously, be selectively adjusted or reconfigured to control or limit the rotational movement of the door 110, so as to prevent the door 110 from colliding with objects in or near the shower enclosure. The hinge assemblies 130 can also be adjusted or reconfigured to provide assistance for a user opening or closing the door.

Figure 2:
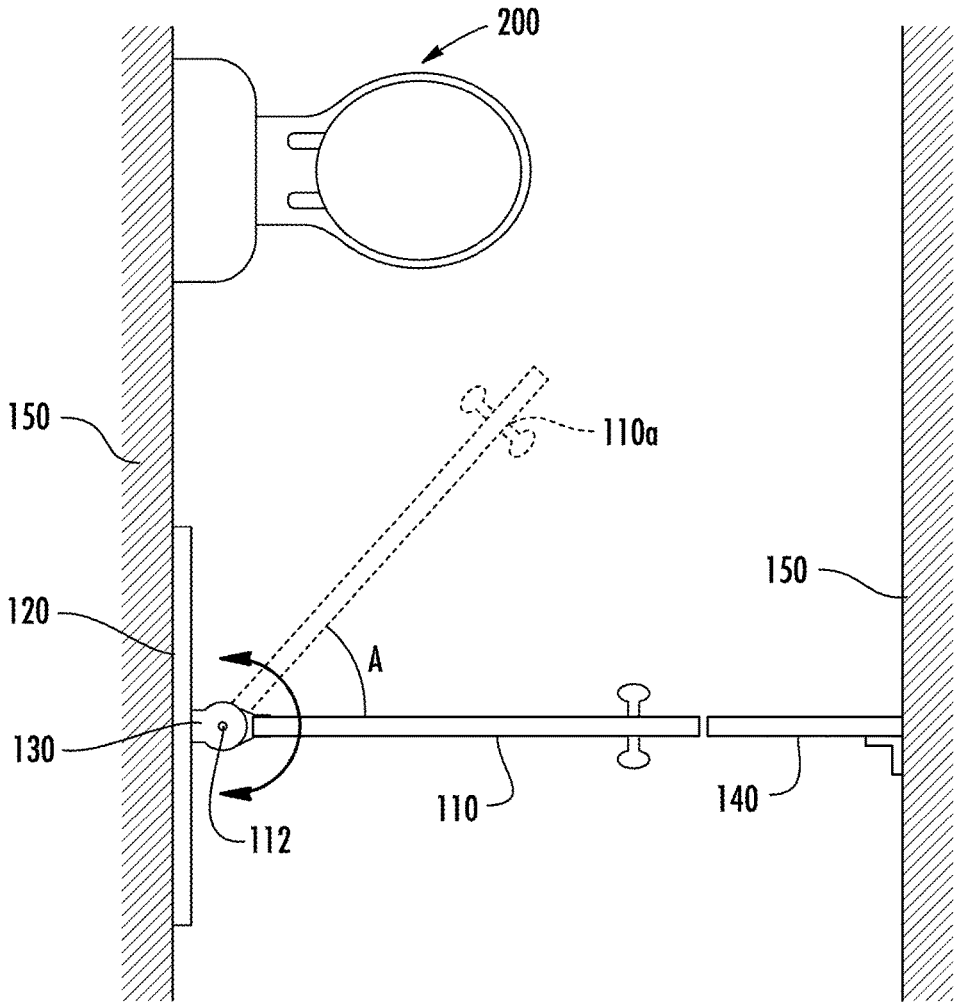
FIG. 2 is a top view of the shower door assembly of FIG. 1 shown at two different positions.
Figure 3A:
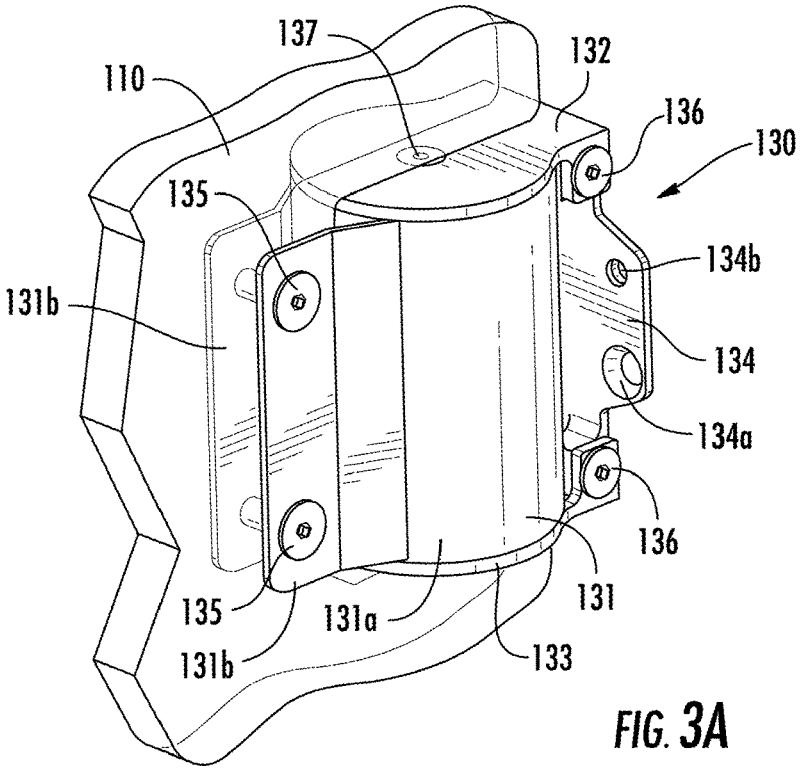
FIG. 3A is a partial perspective view of the shower door assembly of FIG. 1.
Figure 3B:
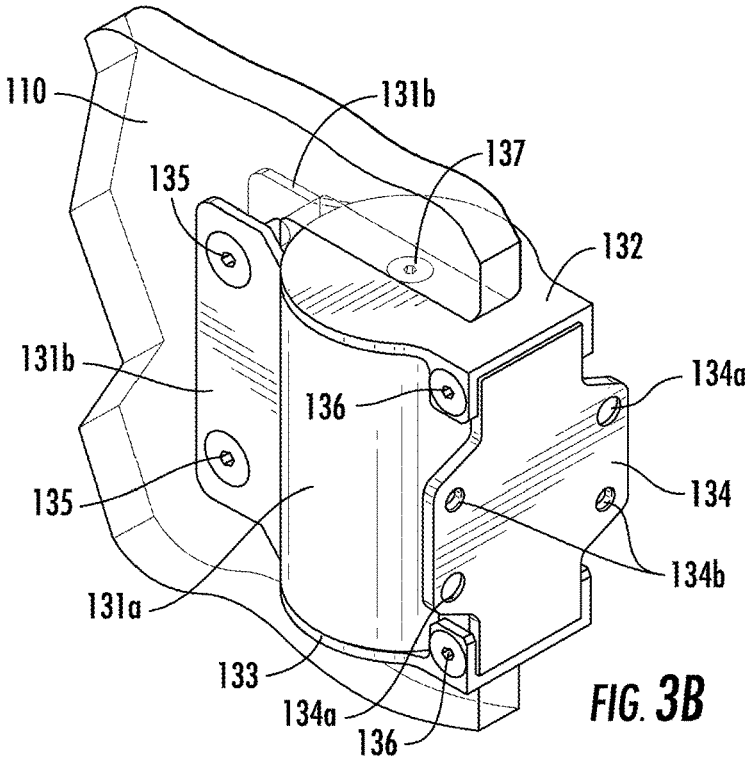
FIG. 3B is another partial perspective view of the shower door assembly of FIG. 1.
Figure 4:
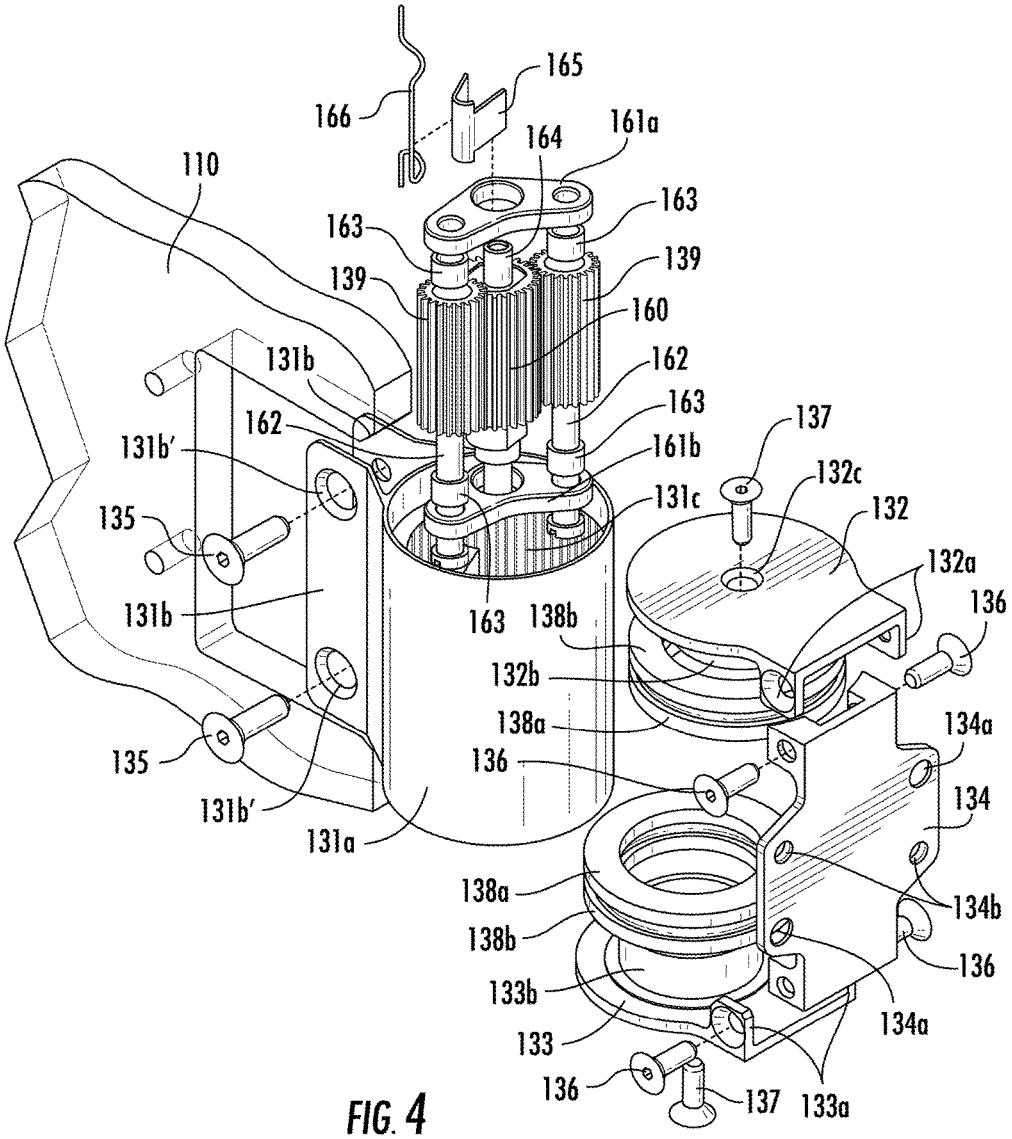
FIG. 4 is an exploded view of a hinge assembly for use with the shower door assembly of FIG. 1 according to an exemplary embodiment.
Figure 5:
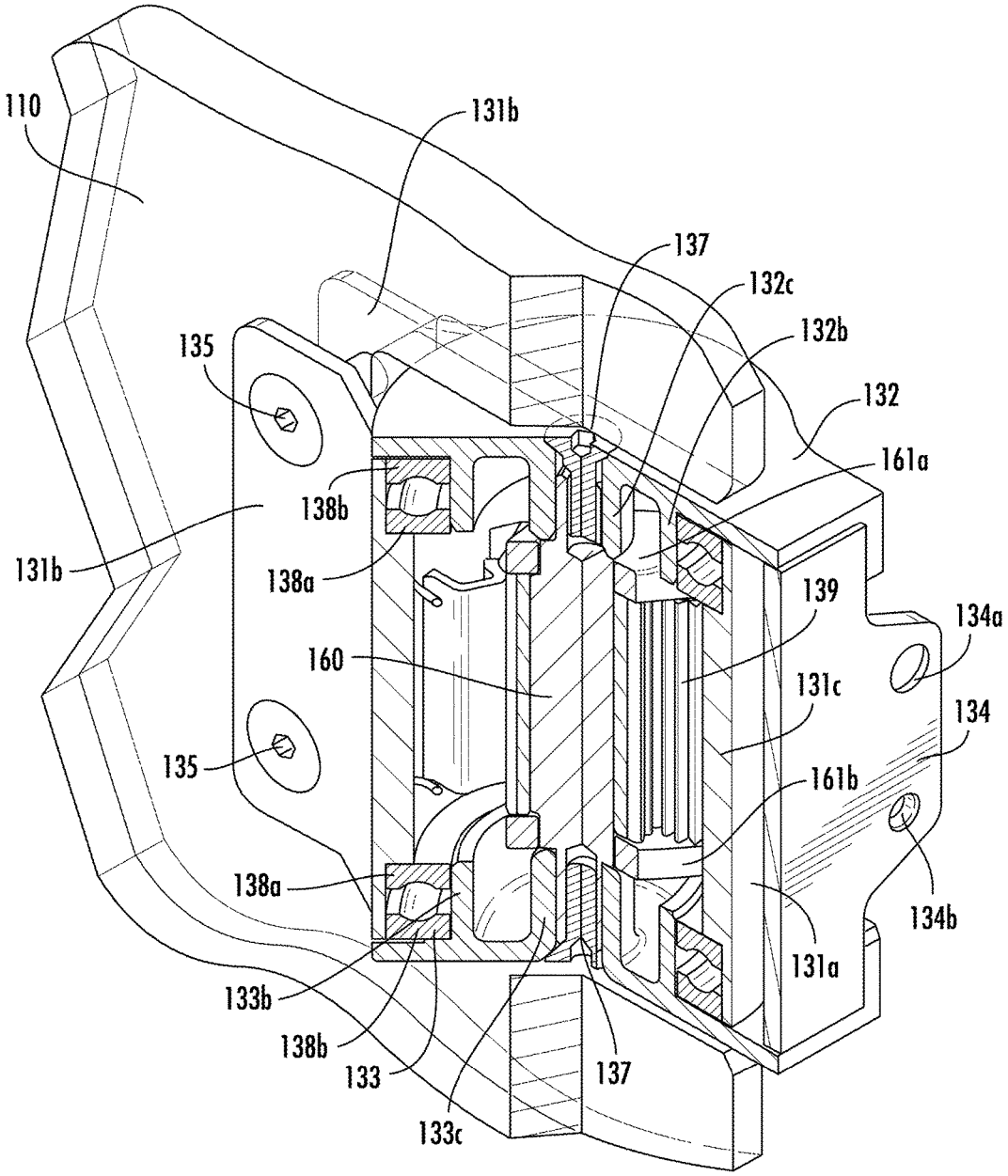
FIG. 5 is a partial cutaway view of the hinge assembly of FIG. 4.

For example, referring to FIG. 2, the shower door assembly 100 is positioned near a plumbing fixture 200, shown as a toilet, according to an exemplary embodiment. With some conventional shower door hinges, the door 110 would typically collide with the plumbing fixture 200 when pivoted or rotated by a user between an open position and a closed position, absent an external device or component to prevent or impede rotational movement of the door 110, such as a striker plate, a door stop, or the like. In contrast, the hinge assemblies 130 have an internal structure including features/elements that can be selectively positioned within, and removed from, the assemblies by a user or an installer to limit or control the rotational movement of the door 110. For example, as shown in FIG. 2, the hinge assemblies 130 can be configured to limit the rotational movement of the door 110 to a rotational endpoint position 110*a*, so as to prevent the door 110 from colliding with the plumbing fixture 200. The hinge assemblies 130 can also include internal features and elements that can control the rotational speed of the door 110, and can assist a user with rotating the door 110 to provide a particular tactile response for a user, the details of which are discussed in the paragraphs that follow.

Referring to FIGS. 3A-7, the hinge assembly 130 includes a body 131 (e.g., hinge body, etc.), an upper member 132 (e.g., upper cap, top cap, etc.), a lower member 133 (e.g., lower cap, bottom cap, etc.), a mount 134 (e.g., mounting plate, mounting bracket, mounting block, etc.), a pair of carriers 161*a*, 161*b* (i.e., upper carrier 161*a* and lower carrier 161*b*), a plurality of planetary gears 139 (e.g., pinion gears, etc.), a damper 165 (e.g., flat spring, etc.) and a stop member 166 (e.g., stopper, indexing spring, etc.). The upper member 132 and the lower member 133 are configured to be coupled to a fixed structural member, such as the first shower panel 120 shown in FIG. 1, via the mount 134. According to the exemplary embodiment shown in the FIGURES, the upper member 132, the lower member 133, and the mount 134 are removably coupled together. According to other exemplary embodiments, the upper member 132, the lower member 133, and the mount 134 are integrally formed to define a unitary structure. The upper member 132 and the lower member 133 are each partially received within the body 131 at upper and lower portions of the body, respectively. The body 131 is configured to be removably coupled to the door 110, and to pivot or rotate with the door 110 relative to the upper and lower members 132, 133 via the plurality of planetary gears 139. The stop member 166 can be selectively positioned within the body 131 by a user or an installer to set a rotational endpoint for the door 110. Similarly, the damper 165 can be selectively positioned within the body 131 by a user or an installer to regulate the rotational speed of the door 110 and/or to assist a user with opening/closing the door 110.

As shown in FIGS. 3A-7, the body 131 includes a cylindrical portion 131*a* and a pair of flanges 131*b* extending outwardly away from a side of the cylindrical portion 131*a*. The flanges 131*b* are oriented substantially parallel to each other and have a generally planar shape. It is appreciated, however, that the flanges 131*b* may have a different shape, such as circular, triangular, or other shapes, according to other exemplary embodiments. The flanges 131*b* are configured to be removably coupled to opposite sides of the door 110, so as to sandwich or clamp a portion of the door 110 therebetween. A gasket or other member may be placed between the door 110 and the flanges 131*b*, so as to protect the door 110 from damage (e.g., if the door 110 is made of glass or other fragile material). Each of the flanges 131*b* includes one or more openings 131*b*' configured to receive a fastener 135 therethrough. The fastener 135 is shown as a bolt, according to the exemplary embodiment shown in the Figures, although the fastener 135 can be another type of fastener sufficient to couple the flanges 131*b* to the door 110, according to other exemplary embodiments.

The cylindrical portion 131*a* includes a hollow interior having a central axis 112 (see FIG. 2) defined by an inner wall 131*c*. The inner wall 131*c* includes a plurality of splines or teeth (e.g., facets, etc.) extending in a longitudinal direction along all, or at least a portion of, the height of the cylindrical portion 131*a*. The plurality of splines or teeth collectively define an internal "ring gear" as part of a planetary gear system. The cylindrical portion 131*a* further includes openings disposed at the top and bottom ends thereof. The cylindrical portion 131*a* is configured to receive an upper member 132 at a top end, and a lower member 133 at a bottom end. The cylindrical portion 131*a* is configured to rotate relative to the upper and lower members 132, 133 to permit relative rotational movement of the door 110.

Still referring to FIGS. 3A-7, the mount 134 is a generally planar member that includes a pair of winged portions for coupling the mount 134 to a fixed structural member, such as a wall of a building (e.g., wall 120, etc.). The winged portions of the mount 134 each include one or more through holes 134*a* and 134*b* for coupling the mount to the fixed structural member. According to an exemplary embodiment, the wing portions of the mount 134 have a generally planar configuration such that the mount 134 may be coupled to another planar surface, such as a glass panel or the like (e.g., panel 120, etc.). The mount 134 further includes upper and lower mounting blocks for coupling the upper and lower members 132, 133, respectively, thereto. For example, each of the upper and lower mounting blocks includes a pair of threaded bores for threadably receiving a screw or bolt 136. One or more bolts 136 can sandwich a portion of the upper member 132 (e.g., tabs 132*a*, etc.) between the bolts 136 and the mount 134 via an upper pair of mounting blocks on the mount 134. Likewise, one or more bolts 136 can sandwich a portion of the lower member 133 (e.g., tabs 133*a*, etc.) between the bolts 136 and the mount 134 via a lower pair of mounting blocks on the mount 134. In this way, the mount 134, the upper member 132, and the lower member 133 can be coupled together. According to other exemplary embodiments, the mount 134, the upper member 132, and the lower member 133 are integrally formed or joined together via welding, etc.

Referring to FIGS. 4-7, each of the upper and lower members 132, 133 includes a cylindrical sleeve 132*b*, 133*b* extending from a surface thereof. The upper cylindrical sleeve 132*b* extends generally downward from the upper member 132, and is configured to receive one or more bearings (e.g., roller bearings, etc.) shown as bearing members 138*a*, 138*b* (e.g., upper race 138*a*, lower race 138*b*, etc.), according to the exemplary embodiment of FIG. 4. The bearing members 138*a*, 138*b* are configured to rotatably couple an upper portion of the body 131 to the upper member 132. Similarly, the lower cylindrical sleeve 133*b* extends generally upward from the lower member 133, and is configured to receive one or more bearing members 138*a*, 138*b*. The bearing members 138*a*, 138*b* are configured to rotatably couple a lower portion of the body 131 to the lower member 133. Thus, the upper member 132 and the lower member 133 are collectively configured to rotatably couple the body 131 thereto.

Still referring to FIGS. 4-7, the hinge assembly 130 includes a center gear 160 including a plurality of longitudinal splines or teeth, and defines a "sun gear" of the planetary gear system. The center gear 160 is configured to be disposed within the interior of the cylindrical portion 131*a* along the central axis 112. The center gear 160 is configured to be coupled to the upper member 132 and to the lower member 133 via one or more bolts 137. For example, the center gear 160 can include a rod 164 extending past an upper end and a lower end of the center gear 160. The rod 164 is configured to threadably receive a bolt 137 through an opening 132*c* of the upper member 132 to couple the center gear 160 to the upper member 132. Likewise, a lower portion of the rod 164 is configured to threadably receive a bolt 137 through an opening 133*c* in the lower member 133 to couple the center gear 160 to the lower member 133. In this manner, the rod 164 can fixedly couple the center gear 164 to the upper and lower members 132, 133.

As shown in FIGS. 4-7, the plurality of planetary gears 139 are each rotatably coupled to an upper carrier 161*a* and a lower carrier 161*b* via a rod 162 and one or more bearings or bushings 163. In the exemplary embodiment of FIGS. 4-7, the hinge assembly 130 includes two planetary gears 139. Each of the planetary gears 139 has a generally elongated cylindrical shape that corresponds to the inner wall 131*c* of the body 131. The elongated cylindrical shape of the planetary gears 139 can, advantageously, help to stabilize the door 110 and provide for better functionality when the door 110 is rotated between an open and a closed position. The planetary gears 139 are configured to rotatably engage the center gear 160 and the ring gear defined by the inner wall 131*c* of the body 131, such that the body 131 can rotate relative to the center gear 160 via the planetary gears 139. The upper and lower carriers 161*a*, 161*b*, the planetary gears 139, the inner wall 131*c*, and the center gear 160 collectively define the planetary gear system of the hinge assembly 130. Each of the planetary gears 139 is configured to rotate about separate axes defined by the upper and lower carriers 161*a*, 161*b*. The planetary gears 139 are also configured to rotate about the central axis 112 when, for example, the door 110 is pivoted or rotated by a user between an open and a closed position.

Figure 6:
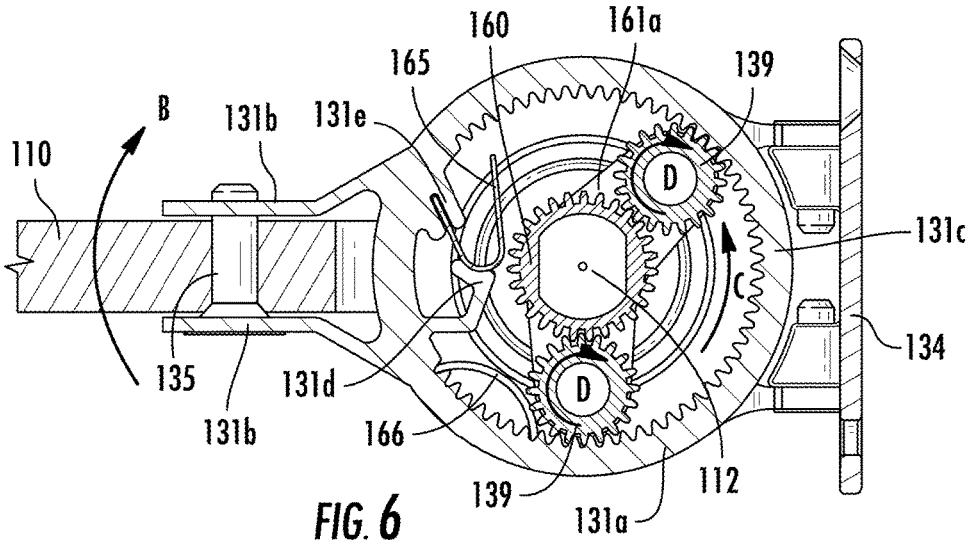
FIG. 6 is a bottom view of the hinge assembly of FIG. 4 with the lower member removed.

For example, referring to FIG. 6, which illustrates a bottom view of the door assembly of FIG. 1 with the bottom member 133 removed, when the door 110 is rotated or pivoted from a first, closed position shown in FIG. 6 to a second, open position in a direction indicated generally by arrow "B," the body 131 will also rotate with the door 110 in the direction of arrow B about central axis 112. Rotation of body 131 in the direction of arrow B will thereby cause the plurality of planetary gears 139 to each rotate about separate axes relative to the upper and lower carriers 161*a*, 161*b* in directions indicated generally by arrow "D." The planetary gears 139 will also rotate relative to the center gear 160 about axis 112 in a direction indicated generally by arrow "C" until one of the planetary gears 139 (e.g., the planetary gear located closest to the damper 165) contacts or engages the damper 165. In the configuration shown in FIG. 6, the damper 165 can, advantageously, dampen the rotational movement of the door 110 when closing the door (e.g., to achieve a "soft close" tactile response).

Still referring to FIGS. 4-7, the stop member 166, shown as a spring (e.g., a wire spring, a curved spring, etc.) according to an exemplary embodiment, can be selectively, removably coupled at a desired position within the interior of the body 131 between a plurality of teeth or splines defined by the inner wall 131*c*. As shown, the stop member 166 has a generally arcuate shape and protrudes inwardly from the inner wall 131*c* toward the central axis 112. The stop member 166 can, advantageously, act to impede or prevent rotational movement of one or more of the planetary gears 139, thereby preventing rotational movement of the body 131 (see, for example, FIG. 6). In this manner, the stop member 166 can define a rotational endpoint for rotation of the door 110, to thereby prevent a collision between the door 110 and objects located adjacent the door 110, such as the plumbing fixture 200 shown in FIG. 2. According to various exemplary embodiments, the stop member 166 can have a variety of different shapes, stiffness, and sizes to allow for customization of the hinge assembly 130, depending on the particular application thereof (e.g., to provide different rotational endpoints, different tactile feel, etc.).

Figure 7:
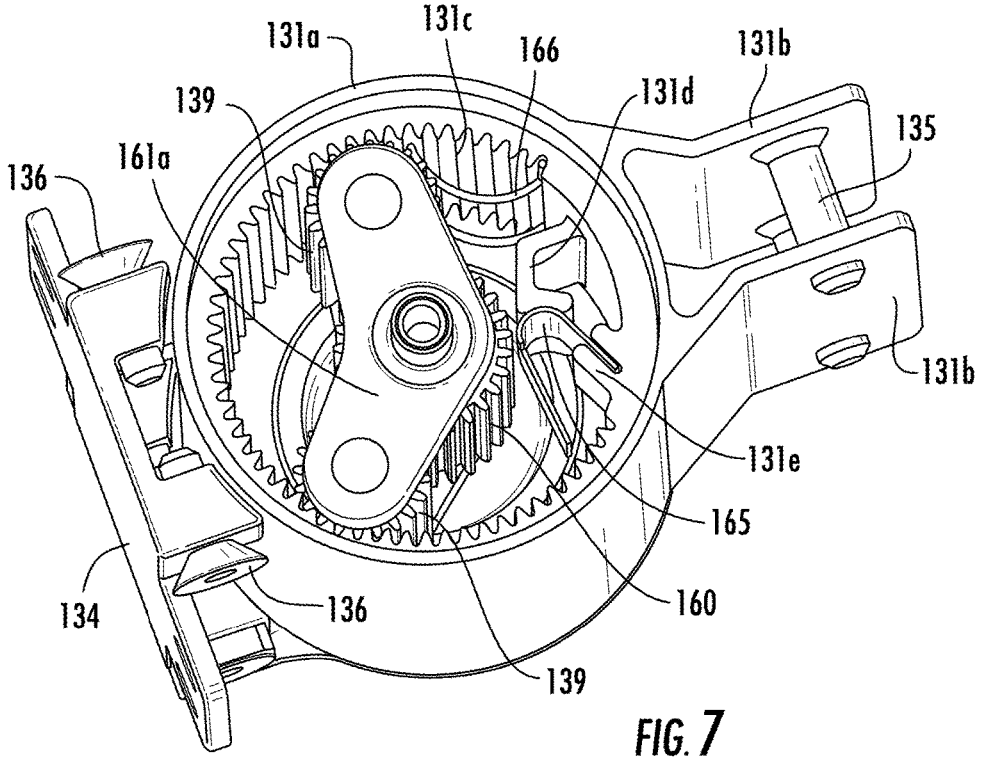
FIG. 7 is a top perspective view of the hinge assembly of FIG. 6 with the upper member removed.

According to an exemplary embodiment, the hinge assembly 130 can include a damper 165, shown as a flat spring according to the exemplary embodiment of FIGS. 4-7. The damper 165 can regulate the tactile feel and/or assist with rotation of the door 110, such as when opening or closing the door 110. For example, as shown in FIGS. 6-7, the damper 165 is disposed within the interior of the cylindrical portion 131*a* adjacent to the inner wall 131*c* via a slot 131*e* and an arm 131*d* extending from the inner wall 131*c*. The damper 165 can be slidably coupled within the slot 131*e* and abutting the arm 131*d* to hold the damper 165 in position relative to the planetary gears 139. A portion of the damper 165 extends inwardly toward the central axis 112, and is configured to deflect or elastically deform when engaged or contacted by a planetary gear 139, such as during opening (shown in FIG. 6) or closing of the door 110. The damper 165 can have a particular stiffness (e.g., spring constant (K), etc.), so as to regulate or control the amount of deflection of the damper 165 when engaged by a planetary gear 139. In this way, the damper 165 can provide a particular tactile response to a user when opening or closing the door 110. The deflection of damper 165 can also assist a user with opening the door 110 and/or to slow the rotational movement of the door when being closed. In addition, at the end of a rotational cycle, such as when closing the door 110, the spaces between the splines or teeth of the planetary gears 139 can act as a "flat" to provide a tactile response to a user (e.g., similar to a cam). The damper 165 can also provide a tactile response to a user, such as a detent-type holding effect for holding the door 110 at a closed position at the end of a rotational cycle.

According to various exemplary embodiments, the hinge assembly 130 can include a viscous material, such as a lubricant or grease, disposed within the interior of the cylindrical portion 131*c* to further control the rotational movement of the door 110. For example, the hinge assembly 130 can include one or more grease ports to allow a user or an installer to selectively control the amount of grease present in the planetary gear system of the hinge assembly 130, to thereby control the rotational speed of the door assembly 100 during opening or closing of the door 110.

According to other exemplary embodiments, the hinge assembly 130 can further include an actuator, such as an electric motor, for controlling the opening or closing of the door 110. The electric motor can be rotatably coupled to the body 131 and fixedly coupled to the mount 134 and/or the upper and lower members 132, 133, according to an exemplary embodiment. According to other exemplary embodiments, the actuator can be coupled to a fixed structure, such as the first shower panel 120. The electric motor can include an internal or an external power source, such as a battery or the like, for operating the actuator. The actuator can, advantageously, control the rotational movement of the door 110, so as to assist a user with, for example, entering or leaving the shower enclosure.

The hinge assembly disclosed herein can be selectively adjusted to control the rotational position of a shower door relative to a fixed structure. The hinge assembly can also be adjusted to assist with opening or closing of the door, and to provide a particular tactile response for a user. In this way, the hinge assembly can help to prevent the shower door from colliding with objects located in a bathing environment adjacent to the shower door (e.g., sinks, toilets, etc.) and can provide assistance for a particular user.

As utilized herein, the terms "approximately," "about," "substantially", and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the application as recited in the appended claims.

The terms "coupled," "connected," and the like, as used herein, mean the joining of two members directly or indirectly to one another. Such joining may be stationary (e.g., permanent) or moveable (e.g., removable or releasable). Such joining may be achieved with the two members or the two members and any additional intermediate members being integrally formed as a single unitary body with one another or with the two members or the two members and any additional intermediate members being attached to one another.

References herein to the positions of elements (e.g., "top," "bottom," "above," "below," etc.) are merely used to describe the orientation of various elements in the FIGURES. It should be noted that the orientation of various elements may differ according to other exemplary embodiments, and that such variations are intended to be encompassed by the present disclosure.

The construction and arrangement of the elements of the faucets as shown in the exemplary embodiments are illustrative only. Although only a few embodiments of the present disclosure have been described in detail, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements, the position of elements may be reversed or otherwise varied, and the nature or number of discrete elements or positions may be altered or varied.

Additionally, the word "exemplary" is used to mean serving as an example, instance, or illustration. Any embodiment or design described herein as "exemplary" is not necessarily to be construed as preferred or advantageous over other embodiments or designs (and such term is not intended to connote that such embodiments are necessarily extraordinary or superlative examples). Rather, use of the word "exemplary" is intended to present concepts in a concrete manner. Accordingly, all such modifications are intended to be included within the scope of the present disclosure. Other substitutions, modifications, changes, and omissions may be made in the design, operating conditions, and arrangement of the preferred and other exemplary embodiments without departing from the scope of the appended claims.

Other substitutions, modifications, changes and omissions may also be made in the design, operating conditions and arrangement of the various exemplary embodiments without departing from the scope of the present application. For example, any element (e.g., body, lower member, upper member, mount, planetary gears, damper, stop member, etc.) disclosed in one embodiment may be incorporated or utilized with any other embodiment disclosed herein. Also, for example, the order or sequence of any process or method steps may be varied or re-sequenced according to alternative embodiments. Any means-plus-function clause is intended to cover the structures described herein as performing the recited function and not only structural equivalents but also equivalent structures. Other substitutions, modifications, changes and omissions may be made in the design, operating configuration, and arrangement of the preferred and other exemplary embodiments.

What is claimed is:

1. A shower door hinge assembly, comprising:

an upper member a lower member a body rotatably coupled to the upper and lower members and configured to be coupled to a pivotable shower door, wherein the body includes an inner wall having a plurality of splines defining a ring gear;

a center gear disposed in the body, wherein the center gear is fixed relative to the upper and lower members;

a plurality of planetary gears rotatably coupled between the body and the center gear, wherein the body is configured to rotate relative to the upper and lower members by the plurality of planetary gears; and a stop member removably coupled to the body, wherein the stop member is configured to be selectively removed from, and repositioned within, the body to set a rotational endpoint for the pivotable shower door.

2. The shower door hinge assembly of claim 1, wherein each of the plurality of planetary gears has a generally elongated cylindrical shape.

3. The shower door hinge assembly of claim 1, wherein the plurality of planetary gears are each coupled to an upper carrier at an upper portion thereof and a lower carrier at a lower portion thereof, wherein the upper and lower carriers define separate axes of rotation for each of the plurality of planetary gears.

4. The shower door hinge assembly of claim 1, wherein the stop member is removably coupled to the inner wall of the body and is configured to engage at least one of the plurality of planetary gears during rotation of the pivotable shower door.

5. The shower door hinge assembly of claim 4, wherein the stop member is a spring.

6. The shower door hinge assembly of claim 1, further comprising a damper removably coupled to the inner wall of the body, wherein the damper is configured to elastically deform in response to contacting at least one of the plurality of planetary gears during rotation of the pivotable shower door so as to provide a particular tactile response for a user.

7. The shower door hinge assembly of claim 1, wherein the body includes a cylindrical portion that defines the inner wall and a pair of flanges extending outwardly away from the cylindrical portion, wherein the pair of flanges are configured to couple the pivotable shower door to the body.

8. A shower door hinge assembly, comprising:

a mounting plate configured to be coupled to a fixed structure;

an upper member coupled to an upper portion of the mounting plate;

a lower member coupled to a lower portion of the mounting plate;

a body rotatably coupled to the upper and lower members and configured to be coupled to a pivotable shower door, wherein the body includes an inner wall having a plurality of splines defining a ring gear;

a center gear disposed in the body, wherein the center gear is fixed relative to the upper and lower members;

a plurality of planetary gears rotatably coupled between the body and the center gear, wherein the body is configured to rotate relative to the upper and lower members by the plurality of planetary gears; and a damper removably coupled to the body, wherein the damper is configured to elastically deform in response to contacting at least one of the plurality of planetary gears during rotation of the pivotable shower door.

9. The shower door hinge assembly of claim 8, wherein each of the plurality of planetary gears has a generally elongated cylindrical shape.

10. The shower door hinge assembly of claim 8, wherein the plurality of planetary gears are each coupled to an upper carrier at an upper portion thereof and a lower carrier at a lower portion thereof, wherein the upper and lower carriers define separate axes of rotation for each of the plurality of planetary gears.

11. The shower door hinge assembly of claim 8, wherein the damper is removably coupled to the inner wall of the body and is configured to engage at least one of the plurality of planetary gears during rotation of the pivotable shower door.

12. The shower door hinge assembly of claim 11, wherein the damper is a flat spring.

13. The shower door hinge assembly of claim 8, further comprising a stop member removably coupled between the inner wall of the body and a planetary gear of the plurality of planetary gears, wherein the stop member is configured to be selectively removed from, and repositioned within, the body to set a rotational endpoint for the pivotable shower door.

14. The shower door hinge assembly of claim 8, wherein the body includes a cylindrical portion that defines the inner wall and a pair of flanges extending outwardly away from the cylindrical portion, wherein the pair of flanges are configured to couple the pivotable shower door to the body.

15. A shower door assembly, comprising:

a pivotable shower door; and a hinge assembly for pivotably coupling the pivotable shower door to a fixed structure, wherein the hinge assembly comprises:

a mounting plate configured to be coupled to the fixed structure;

an upper member extending from an upper portion of the mounting plate;

a lower member extending from a lower portion of the mounting plate;

a body coupled to the pivotable shower door and rotatably coupled to the upper and lower members, wherein the body includes an inner wall having a plurality of splines defining a ring gear;

a center gear disposed in the body, wherein the center gear is fixed relative to the upper and lower members;

a plurality of planetary gears rotatably coupled between the body and the center gear, wherein the body is configured to rotate relative to the upper and lower members by the plurality of planetary gears; and a stop member removably coupled to the body;

wherein the stop member is configured to be selectively removed from, and repositioned within, the body to set a rotational endpoint for the pivotable shower door.

16. The shower door assembly of claim 15, further comprising a damper removably coupled to the inner wall of the body, wherein the damper is configured to elastically deform in response to contacting at least one of the plurality of planetary gears during rotation of the pivotable shower door so as to provide a particular tactile response for a user.

17. The shower door assembly of claim 15, wherein the body includes a cylindrical portion that defines the inner wall and a pair of flanges extending outwardly away from the cylindrical portion, wherein the pair of flanges couple the pivotable shower door to the body.

* * * * *